US006427896B1

(12) United States Patent
Ho et al.

(10) Patent No.: US 6,427,896 B1
(45) Date of Patent: Aug. 6, 2002

(54) SAFETY DEVICE FOR PNEUMATIC NAILERS

(76) Inventors: Roman Ho; An-Chi Liu, both of 24, 36th Rd., Taichung Industrial Park, Taichung City (TW)

( * ) Notice: Subject to any disclaimer, the term of this patent is extended or adjusted under 35 U.S.C. 154(b) by 0 days.

(21) Appl. No.: 10/055,190

(22) Filed: Jan. 25, 2002

(51) Int. Cl.[7] ..... B25C 1/04
(52) U.S. Cl. ..... 227/142; 227/8
(58) Field of Search ..... 227/8, 142

(56) References Cited

U.S. PATENT DOCUMENTS 5,219,110 A * 6/1993 Mukoyama ..... 227/8
5,385,286 A * 1/1995 Johnson, Jr. ..... 227/142
5,579,977 A * 12/1996 Yang ..... 227/8
6,012,622 A * 1/2000 Weinger et al. ..... 227/142
6,024,267 A * 2/2000 Chen ..... 227/8
6,170,729 B1 * 1/2001 Lin ..... 227/142

* cited by examiner

*Primary Examiner*—Scott A. Smith
(74) *Attorney, Agent, or Firm*—Charles E. Baxley

(57) ABSTRACT

A safety device for a pneumatic nailer includes a push rod which has a connection end extending through an adjusting member and a pivotal member which is mounted by the adjusting member. The adjusting member is rotatable relative to the pivotal member which is connected to a connection plate. The hole for the threaded rod of the pivotal member has tow straight insides matched with two plain surfaces on the threaded rod. Only one groove is required in the adjusting member to receive a clamp whose two legs contact two notches in the pivotal member.

3 Claims, 6 Drawing Sheets

SAFETY DEVICE FOR PNEUMATIC NAILERS

FIELD OF THE INVENTION

The present invention relates to a safety device that is easily assembled and requires less number of parts.

BACKGROUND OF THE INVENTION

A conventional safety device for pneumatic nailers is shown in FIGS. 1 and 2 and generally includes a push rod 10 having a threaded end 101 which is threadedly connected with a threaded hole 121 in an adjusting member 12. The adjusting member 12 is rotatably mounted to a pivotal member 13 which has a threaded rod 133 which extends through a hole 111 of a connection plate 111 and is connected with a nut 16. The connection plate 11 is connected to the trigger of the pneumatic nailer and the push rod 10 is movably connected to a nose portion of the nailer so that the trigger cannot be pulled if the push rod 10 is not pushed backward to move the connection plate 11. The threaded rod 133 has two surfaces 134 (only one is shown) so that when connecting with the nut 16, a wrench is used to hold at the surfaces 134 to prevent the pivotal member 13 from rotating with the nut 16. This takes time and requires a wrench to complete the engagement. The adjusting member 12 has two grooves 122 and 123 which respectively receive two C-shaped clamps 14, 15 therein. Two legs of the clamp 14 extend through the groove 122 and contact the notches 131 in the pivotal member 13. Two legs of the clamp 15 extend through the groove 123 and contact the notches 132 in the pivotal member 13. By the two clamps 14, 15, the adjusting member 12 can be rotated on the pivotal member 13 and positioned relative to the pivotal member 13. The two clamps 14, 15 both are connected to the adjusting member 12 so that the adjusting member 12 needs to be machined to have many grooves and holes. In some situations, there are only two threads connection between the threaded end 101 and the threaded hole 121, the huge vibration when operating the pneumatic nailer could separate the push rod and the adjusting member 12.

SUMMARY OF THE INVENTION

In accordance with one aspect of the present invention, there is provided a safety device for pneumatic nailers and the device comprises a push rod having a connection end which has a threaded section and a distal section. An adjusting member has a threaded hole defined through a first end of the adjusting member so that the threaded section is connected therewith. A recess is defined a second end of the adjusting member so as to receive a first end of a pivotal member. A first groove is defined in an outside of the second end of the adjusting member and two apertures communicate with the first groove and are defined through the adjusting member. A threaded rod extends from a second end of the pivotal member and a second groove is defined in an outer periphery of the first end of the pivotal member. Two notches communicate with the second groove and are defined through the pivotal member. A clamp is received in the first groove and two legs of the clamp extend through the apertures and are engaged with the notches. A passage is defined through the pivotal member so that the distal section extends through the threaded hole and the passage. Two plain surfaces are defined in a root portion of the threaded rod. A connection plate has a hole which has two straight insides and the threaded rod extends through the hole. The two plain surfaces of the threaded rod are engaged with the two straight insides of the hole and a nut is engaged with the threaded rod.

The primary object of the present invention is to provide a safety device for a pneumatic nailer wherein the connection of the nut and the threaded rod of the pivotal member needs no additional wrench.

Another object of the present invention is to provide a safety device for a pneumatic nailer wherein the connection end of the push rod extends in the pivotal member so that the push rod is- prevented from being disengaged from the adjusting member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
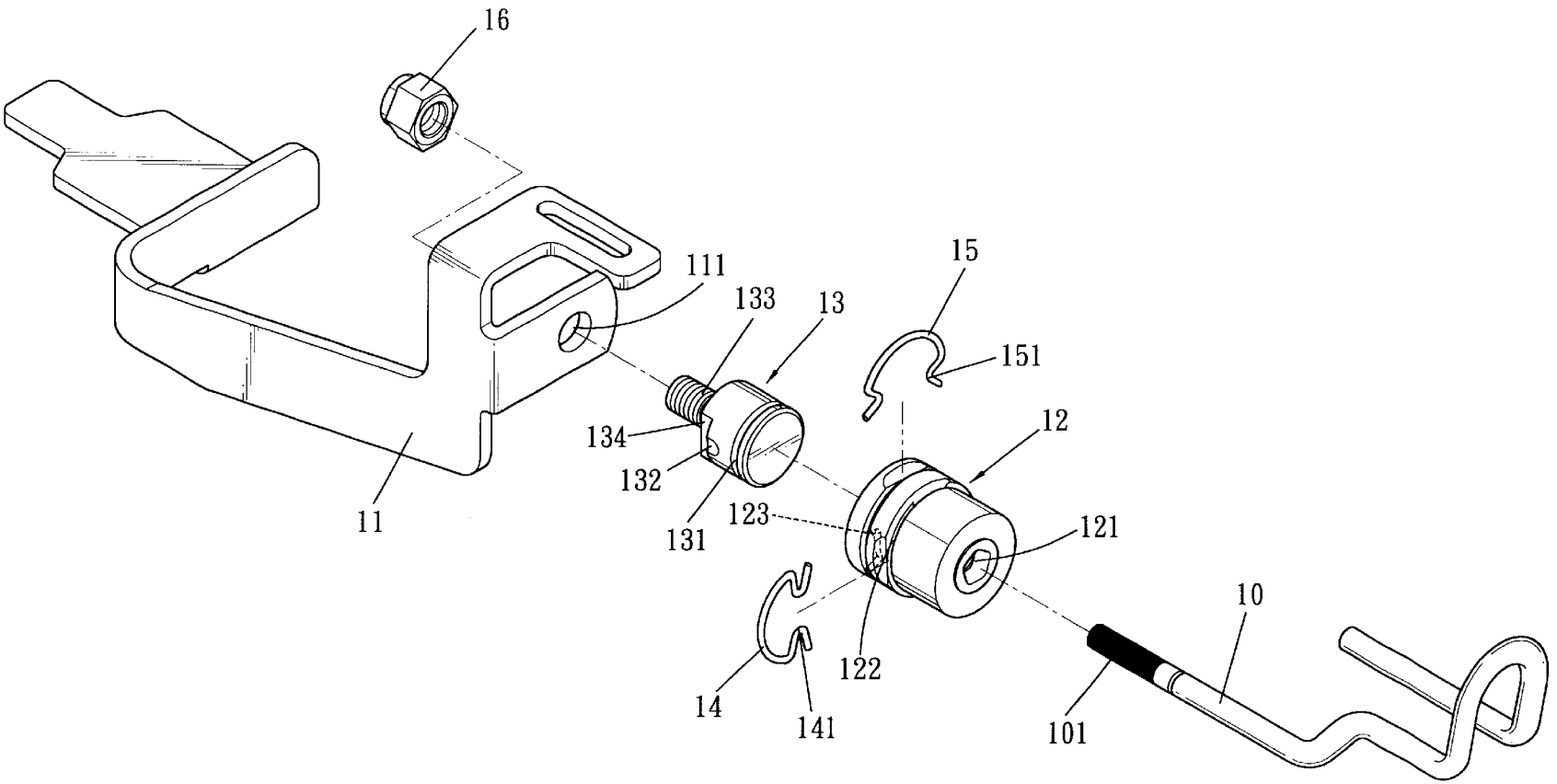
FIG. 1 PRIOR ART
FIG. 1 is an exploded view to show a conventional safety device.
Figure 2:
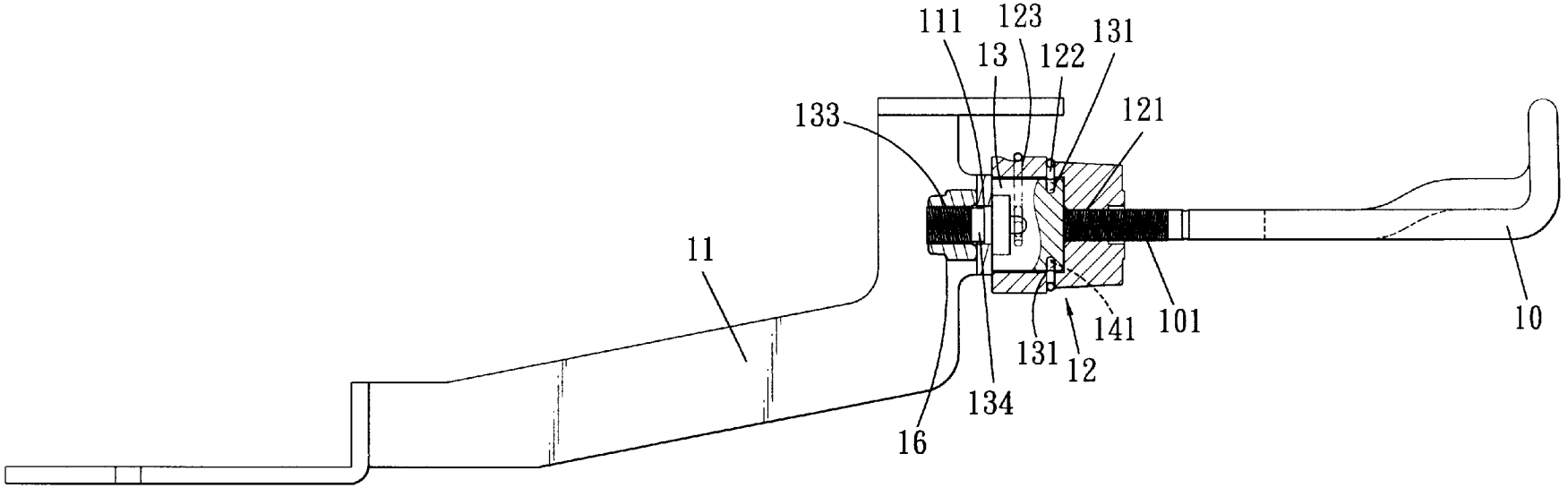
FIG. 2 PRIOR ART
FIG. 2 is a cross sectional view to show the assembly of the conventional safety device.
Figure 3:
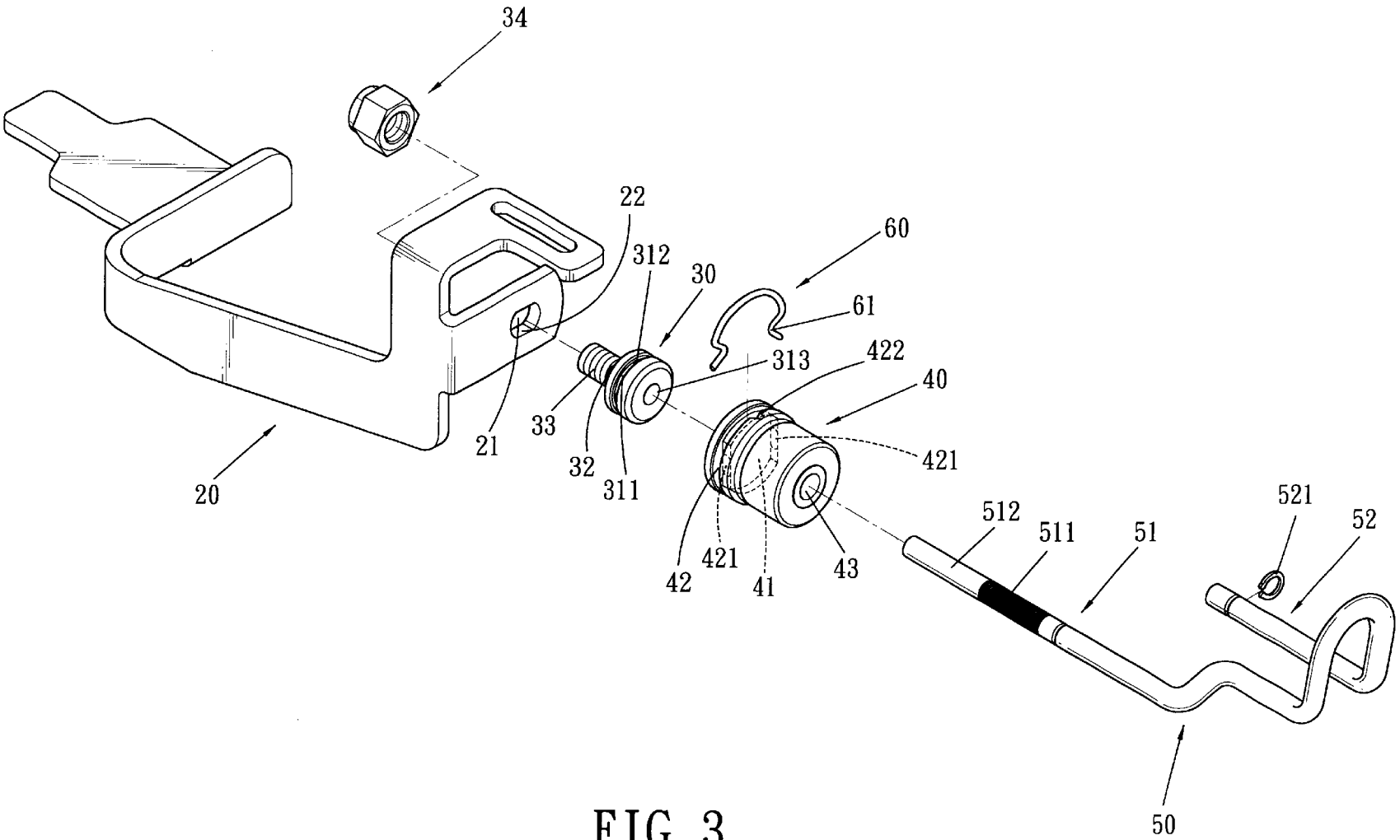
FIG. 3 is an exploded view to show a safety device of the present invention.
Figure 4:
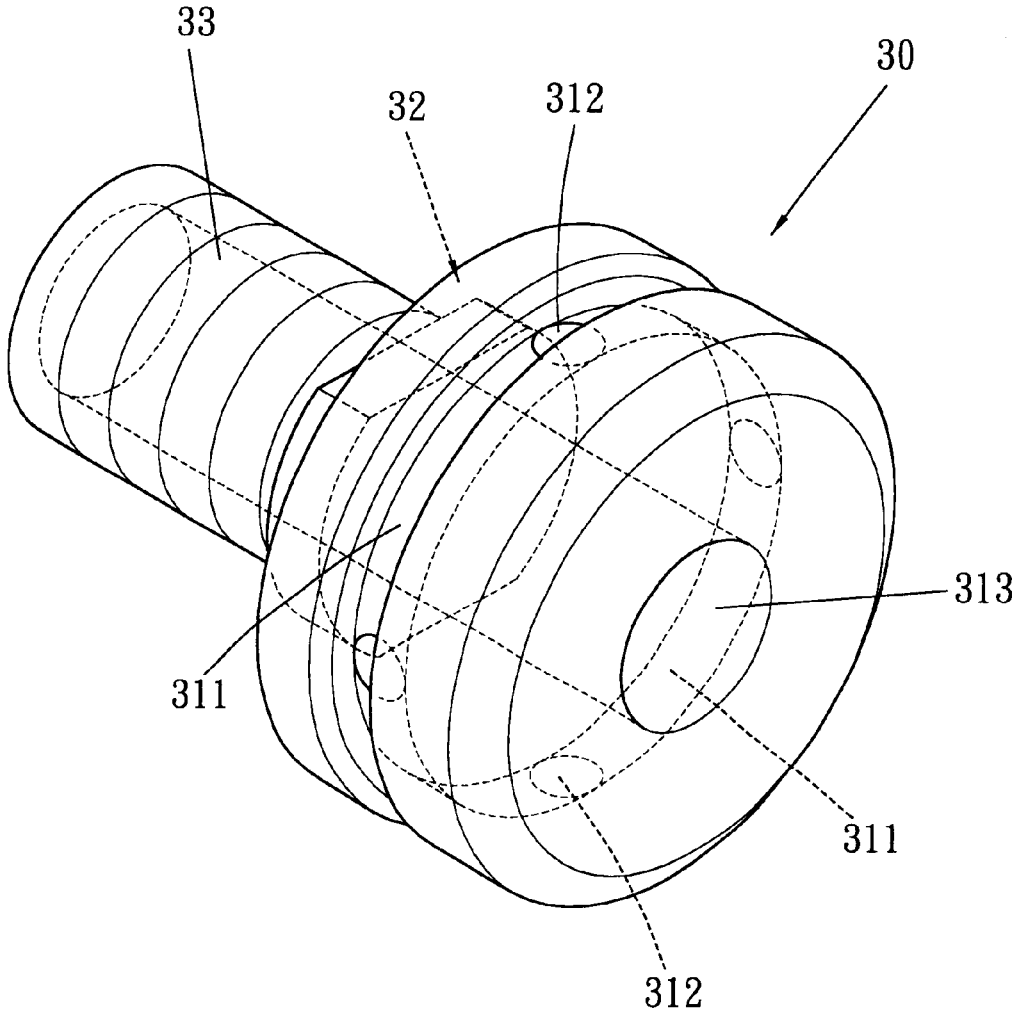
FIG. 4 shows the pivotal member of the safety device of the present invention.
Figure 5:
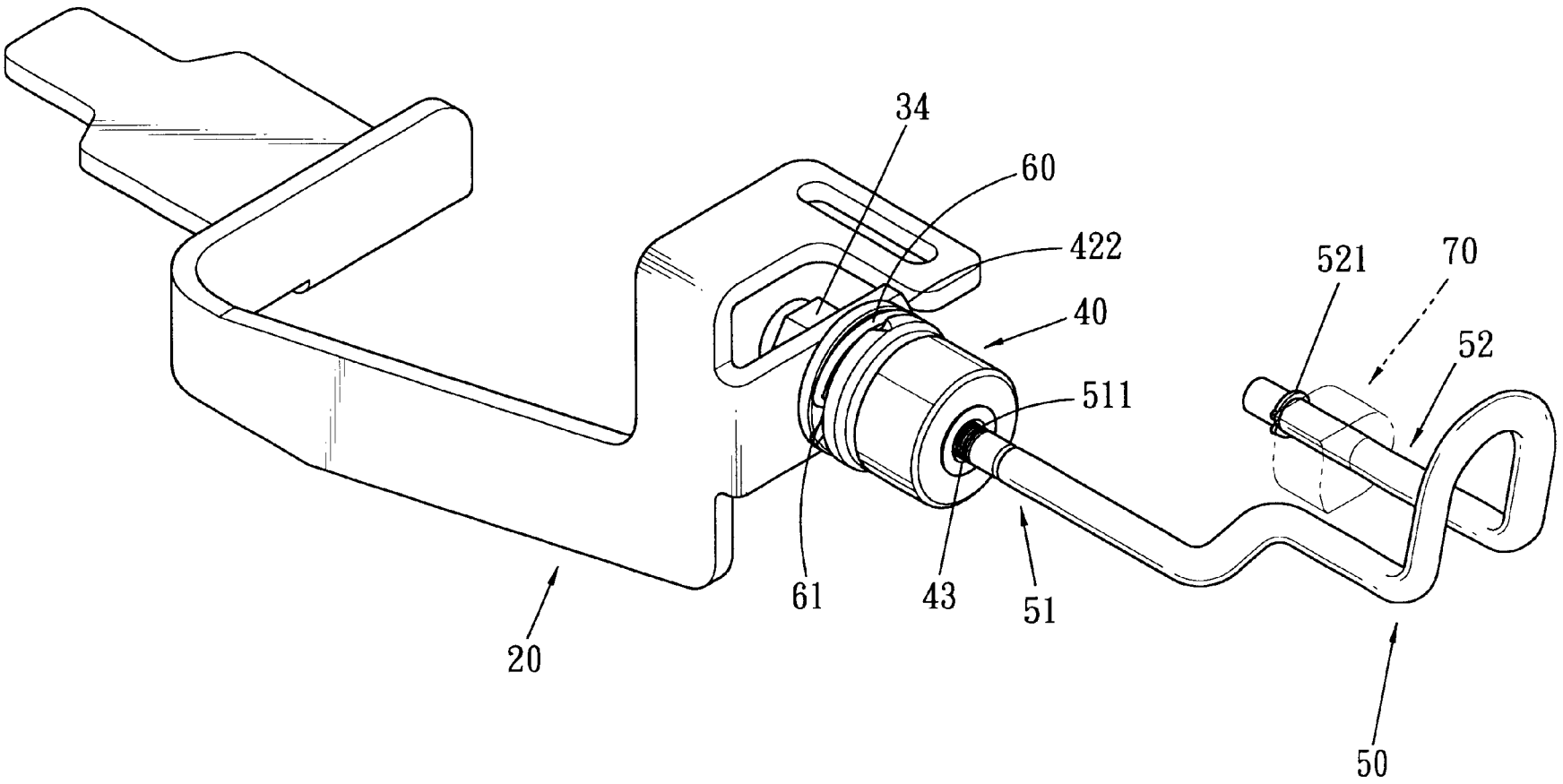
FIG. 5 is a perspective view to show the safety device of the present invention.
Figure 6:
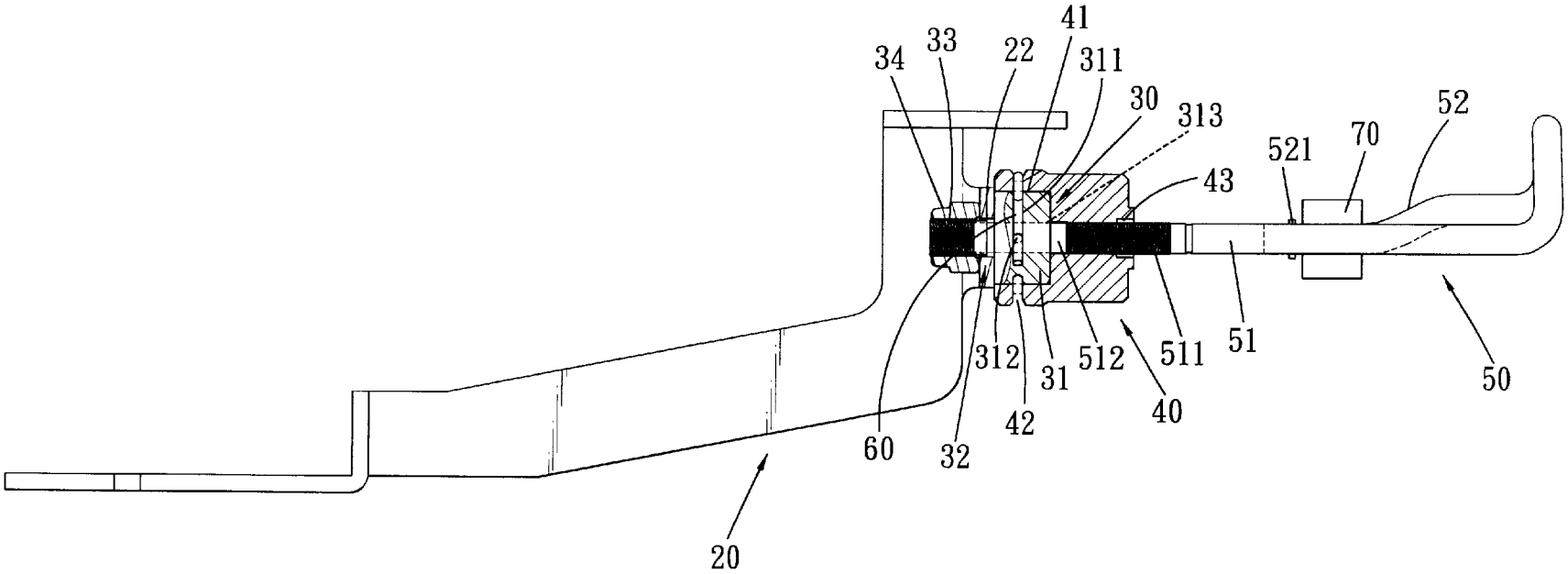
FIG. 6 is a cross sectional view to show the assembly of the conventional safety device.

Referring to FIGS. 3 to 6, the safety device of the present invention comprises a push rod 50 having an engaging end 52 which is connected to the pneumatic nailer 70 (FIG. 5), and a connection end 51 which has a threaded section 511 and a distal section 512. The engaging end 52 of the push rod 50 has a clip 521 mounted thereto so that it does not easily disengage from the nailer.

An adjusting member 40 has a threaded hole 43 defined through a first end of the adjusting member 40. A recess 41 is defined a second end of the adjusting member 40 and communicates with the threaded hole 43. A first groove 42 is defined in an outside of the second end of the adjusting member 40 and two apertures 421 communicate with the first groove 42 and are defined through the adjusting member 40.

A pivotal member 30 has a first end received in the recess 41 in the adjusting member 40 and a threaded rod 33 extends from a second end of the pivotal member 30. A second groove 311 are defined in an outer periphery of the first end of the pivotal member 30 and two notches 312 communicate with the second groove 311 and are defined through the pivotal member 30.

A clamp 60 is received in the first groove 42 and two legs of the clamp 60 extend through the apertures 421 and are engaged with the notches 312. Therefore, the adjusting member 40 is able to be rotated relative to the pivotal member 30. A finger recess 422 is defined in the outer periphery of the adjusting member 40 and communicates with the first groove 42 so that the clamp 60 can be conveniently removed from the first groove 42 by picking the clamp 60 via the finger recess 422.

A passage 313 is defined through the pivotal member 30 so that the distal section 512 extends through the threaded hole 43 and the passage 313. The threaded section 511 of the adjusting member 40 is engaged with the threaded hole 43. Two plain surfaces 32 are defined in a root portion of the threaded rod 33.

A connection plate 20 has a hole 21 defined through a transverse portion at a first end of the connection plate 20. The hole 21 has two straight insides and the threaded rod 33 extends through the hole 21 and is engaged with a nut 34. The two plain surfaces 32 of the threaded rod 33 are engaged with the two straight insides of the hole 21 so that when connecting the nut 34 to the threaded rod 33, no wrench is required.

Because the connection end 51 of the push rod 50 extends in the pivotal member 50 so that even if the threaded section 511 of the push rod 50 is disengaged from the threaded hole 43, the adjusting member 40 will not be separated from the push rod 50.

While we have shown and described the embodiment in accordance with the present invention, it should be clear to those skilled in the art that further embodiments may be made without departing from the scope of the present invention.

What is claimed is:

1. A safety device for pneumatic nailers, comprising:

a push rod having a connection end which has a threaded section and a distal section, said push rod having an engaging end which is adapted to be connected to the pneumatic nailer;

an adjusting member having a threaded hole defined through a first end of said adjusting member, a recess defined a second end of said adjusting member and communicating with said threaded hole, a first groove defined in an outside of said second end of said adjusting member and two apertures communicating with said first groove and defined through said adjusting member;

a pivotal member having a first end received in said recess in said adjusting member and a threaded rod extending from a second end of said pivotal member, a second groove defined in an outer periphery of said first end of said pivotal member, two notches communicating with said second groove and defined through said pivotal member;

a clamp received in said first groove and two legs of said clamp extending through said apertures and engaged with said notches, a passage defined through said pivotal member, said distal section extending through said threaded hole and said passage, said threaded section of said adjusting member engaged with said threaded hole, two plain surfaces defined in a root portion of said threaded rod, and a connection plate having a hole which has two straight insides and said threaded rod extending through said hole, said two plain surfaces of said threaded rod engaged with said two straight insides of said hole and a nut engaged with said threaded rod.

2. The device as claimed in claim 1, wherein said engaging end of said push rod has a clip mounted thereto.

3. The device as claimed in claim 1 further comprising a finger recess defined in said outer periphery of said adjusting member and communicating with said first groove.

* * * * *